US008065839B2

(12) United States Patent
Conlin

(10) Patent No.: US 8,065,839 B2
(45) Date of Patent: Nov. 29, 2011

(54) FLASHING ASSEMBLY

(75) Inventor: Kelly Conlin, Stillwater, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 12/558,179

(22) Filed: Sep. 11, 2009

(65) Prior Publication Data

US 2010/0064628 A1 Mar. 18, 2010

Related U.S. Application Data

(63) Continuation of application No. 10/856,380, filed on May 27, 2004, now Pat. No. 7,591,106.

(60) Provisional application No. 60/531,247, filed on Dec. 19, 2003.

(51) Int. Cl.
*E06B 7/14* (2006.01)

(52) U.S. Cl. ..... 52/58; 52/302.6

(58) Field of Classification Search ..... 52/58, 95, 52/96, 202, 204.5, 302.3, 302.6
See application file for complete search history.

(56) References Cited

U.S. PATENT DOCUMENTS

| | | | |
|---|---|---|---|
| 1,270,541 | A | 6/1918 | Mueller |
| 1,677,130 | A | 7/1928 | Cherry |
| 2,154,734 | A | 4/1939 | Doing |
| 2,245,965 | A | 6/1941 | Hyman |
| 2,648,107 | A | 8/1953 | Bates, Jr. |
| 2,697,932 | A | 12/1954 | Goodwin |
| 3,239,977 | A | 3/1966 | Shore |
| 4,492,062 | A | 1/1985 | Levenez |
| 4,555,882 | A | 12/1985 | Moffitt et al. |
| 4,745,716 | A | 5/1988 | Kuypers |
| 4,966,819 | A | 10/1990 | Schatz et al. |
| 5,072,552 | A | 12/1991 | Sauder |
| 5,179,804 | A | 1/1993 | Young |
| 5,377,464 | A | 1/1995 | Mott et al. |
| 5,581,959 | A | 12/1996 | Occhipinti |
| 5,822,933 | A | 10/1998 | Burroughs et al. |
| 5,921,038 | A | 7/1999 | Burroughs et al. |
| 6,038,821 | A | 3/2000 | Larson |
| 6,070,370 | A | 6/2000 | Locke |
| 6,098,343 | A | 8/2000 | Brown et al. |
| 6,276,099 | B1 | 8/2001 | O'Shea |
| 6,293,064 | B1 | 9/2001 | Larson |
| 6,298,614 | B1 | 10/2001 | Fisher |
| 6,305,130 | B1 | 10/2001 | Ackerman, Jr. |
| 6,371,188 | B1 | 4/2002 | Baczuk et al. |
| 6,385,925 | B1 | 5/2002 | Wark |

(Continued)

OTHER PUBLICATIONS

"U.S. Appl. No. 10/856,380, Final Office Action mailed May 12, 2008", 8 pgs.

(Continued)

*Primary Examiner* — Basil Katcheves
*Assistant Examiner* — Matthew J Smith
(74) *Attorney, Agent, or Firm* — Schwegman, Lundberg & Woessner, P.A.

(57) ABSTRACT

A moisture management system for use in construction of buildings, particularly for partially covering the framework of a rough opening in a structure. The system has a body having a plurality of pathways to facilitate fluid between the system and any fixture installed adjacent to the system. The pathways allow fluid, especially water, to flow away from the installation surfaces and down along the exterior of the building.

20 Claims, 9 Drawing Sheets

U.S. PATENT DOCUMENTS

| | | | | |
|---|---|---|---|---|
| 6,401,401 | B1 | 6/2002 | Williams | |
| 6,401,402 | B1 | 6/2002 | Williams | |
| 6,470,638 | B1 | 10/2002 | Larson | |
| 6,526,709 | B1 | 3/2003 | Jacobsen | |
| 6,725,610 | B2 | 4/2004 | Murphy et al. | |
| 6,789,359 | B2 | 9/2004 | Bauman et al. | |
| 6,941,713 | B2 * | 9/2005 | Williams | 52/302.6 |
| 7,059,087 | B2 | 6/2006 | Allen | |
| 7,591,106 | B2 | 9/2009 | Conlin | |
| 7,832,156 | B2 * | 11/2010 | Trotter | 52/302.3 |
| 2001/0034986 | A1 | 11/2001 | Thomas et al. | |
| 2002/0108326 | A1 | 8/2002 | Ackerman, Jr. | |
| 2002/0129557 | A1 | 9/2002 | Young | |
| 2003/0106269 | A1 | 6/2003 | Bauman et al. | |
| 2003/0177711 | A1 | 9/2003 | Gatherum | |
| 2003/0177712 | A1 | 9/2003 | Gatherum | |
| 2003/0177725 | A1 | 9/2003 | Gatherum | |
| 2003/0177727 | A1 | 9/2003 | Gatherum | |
| 2003/0177736 | A1 | 9/2003 | Gatherum | |
| 2004/0200160 | A1 | 10/2004 | Derderian | |
| 2004/0216414 | A1 | 11/2004 | Dickinson | |
| 2005/0034385 | A1 | 2/2005 | Broad et al. | |
| 2005/0055912 | A1 | 3/2005 | Teodorovich | |
| 2005/0144865 | A1 | 7/2005 | Ellingson | |
| 2005/0166470 | A1 | 8/2005 | Allen | |
| 2005/0166471 | A1 | 8/2005 | Allen | |
| 2005/0183345 | A1 | 8/2005 | Allen | |
| 2005/0210768 | A1 * | 9/2005 | Lawson et al. | 52/97 |
| 2006/0143994 | A1 | 7/2006 | Allen | |
| 2006/0156639 | A1 | 7/2006 | Allen | |
| 2006/0168902 | A1 | 8/2006 | Allen | |
| 2006/0283113 | A1 | 12/2006 | Trotter | |
| 2007/0094957 | A1 | 5/2007 | Burton et al. | |
| 2007/0214738 | A1 | 9/2007 | Koessler | |
| 2008/0141602 | A1 | 6/2008 | Allen | |
| 2008/0229676 | A1 | 9/2008 | Allen | |

OTHER PUBLICATIONS

"U.S. Appl. No. 10/856,380, Non-Final Office Action mailed Oct. 2, 2008", 9 Pgs.

"U.S. Appl. No. 10/856,380, Non-Final Office Action Mailed Nov. 9, 2007", 12 pgs.

"U.S. Appl. No. 10/856,380, Preliminary Amendment filed Nov. 9, 2006", 7 pgs.

"U.S. Appl. No. 10/856,380, Preliminary Amendment mailed Mar. 3, 2006", 7 pgs.

"U.S. Appl. No. 10/856,380, Response filed Feb. 11, 2008 to Non-Final Office Action mailed Nov. 9, 2007", 16 pgs.

"U.S. Appl. No. 10/856,380, Notice of Allowance mailed May 7, 2009", 08 pgs.

"International Application Serial No. PCT/US2004/042323, International Search Report mailed", 3 pgs.

* cited by examiner

FLASHING ASSEMBLY

CROSS-REFERENCE TO RELATED APPLICATIONS

This application is a continuation of U.S. application Ser. No. 10/856,380, filed May 27, 2004, now U.S. Pat. No. 7,591,106 which claims priority under 35 U.S.C. 119(e) to U.S. Provisional Application No. 60/531,247, filed Dec. 19, 2003 and entitled DEVICE AND METHOD FOR INHIBITING MOISTURE BUILDUP BETWEEN FIXTURES IN EXTERIOR WALLS AND THEIR FRAMES. The entire disclosure of U.S. Provisional Application No. 60/531,247 is incorporated herein.

FIELD OF THE DISCLOSURE

This disclosure concerns construction materials and methods of using the materials in building construction. In particular, the disclosure is directed to a device and a system that inhibits moisture buildup between fixtures, such as exterior windows and doors, and the building frames.

BACKGROUND

When constructing a building with exterior openings, such as windows and doors, a rough opening is framed in when the wall is constructed. Later, a fixture such as a window or door is placed in this rough opening. One often-encountered problem is that the wood framework of these rough openings has a tendency to rot or otherwise deteriorate under certain conditions. This rotting is usually caused by moisture leaking in along the fixture and becoming trapped between the fixture and the framework of the rough opening in which the fixture sits.

Due to the increasing awareness of energy conversation, there is a desire to build more energy efficient buildings. This is generally accomplished by building a leak-free or leak-reduced structure, which is intended to be generally air-tight. However, problems occur when water or other liquid is present in the framing of these air-tight buildings, because the framework has been sealed in a manner that inhibits air movement and drying out easily.

A product is needed that inhibits moisture from coming in contact with, or building up in, the framework or wall, thusly protecting the framework of the rough opening and wall from rotting. Various devices have attempted to solve this problem. The system of the present disclosure provides a solution to the problem that is truly effective. Previous devices that were positioned on the rough sill, with the fixture installed on top, did not allow for effective transport of fluid (e.g., air or water) out of the space between the fixture and the sill once the fixture was fully installed. The device of this disclosure has solved this problem of effective transport of the fluid out of the space between the fixture and the sill once the fixture is fully installed.

SUMMARY

The system of this disclosure inhibits moisture contact and build-up between the framework of the rough opening and the fixture that is installed in the frame. Further, it channels the moisture from this space between the fixture and the framework of the rough opening out to the external surface of the leak reducing apparatus.

In one particular aspect, this disclosure is directed to a flashing system for partially covering the framework of a rough opening in a structure, the system comprising a body having an inner edge and a plurality of pathways to facilitate fluid transport from the inner edge and between the system and any fixture installed adjacent to the system.

In another particular aspect, this disclosure is directed to a flashing system for use with a rough opening, the system comprising a body having a first end and a second opposite end, a first face having a length from the first end to the second end, and a second face having a length from the first end to the second end, the second face being positioned at an angle of about 90 degrees to, and continuous with the first face. The first face has a depth from a first inner side edge to the angle and the second face having a depth from the angle to a second lower edge. The system has at least one fluid pathway extending along the first face and the second face, the fluid pathway sloping in a downward direction from the first edge toward the angle and extending generally vertically from the angle along the second face.

Other features are disclosed.

DESCRIPTION OF THE INVENTION

Figure 1:
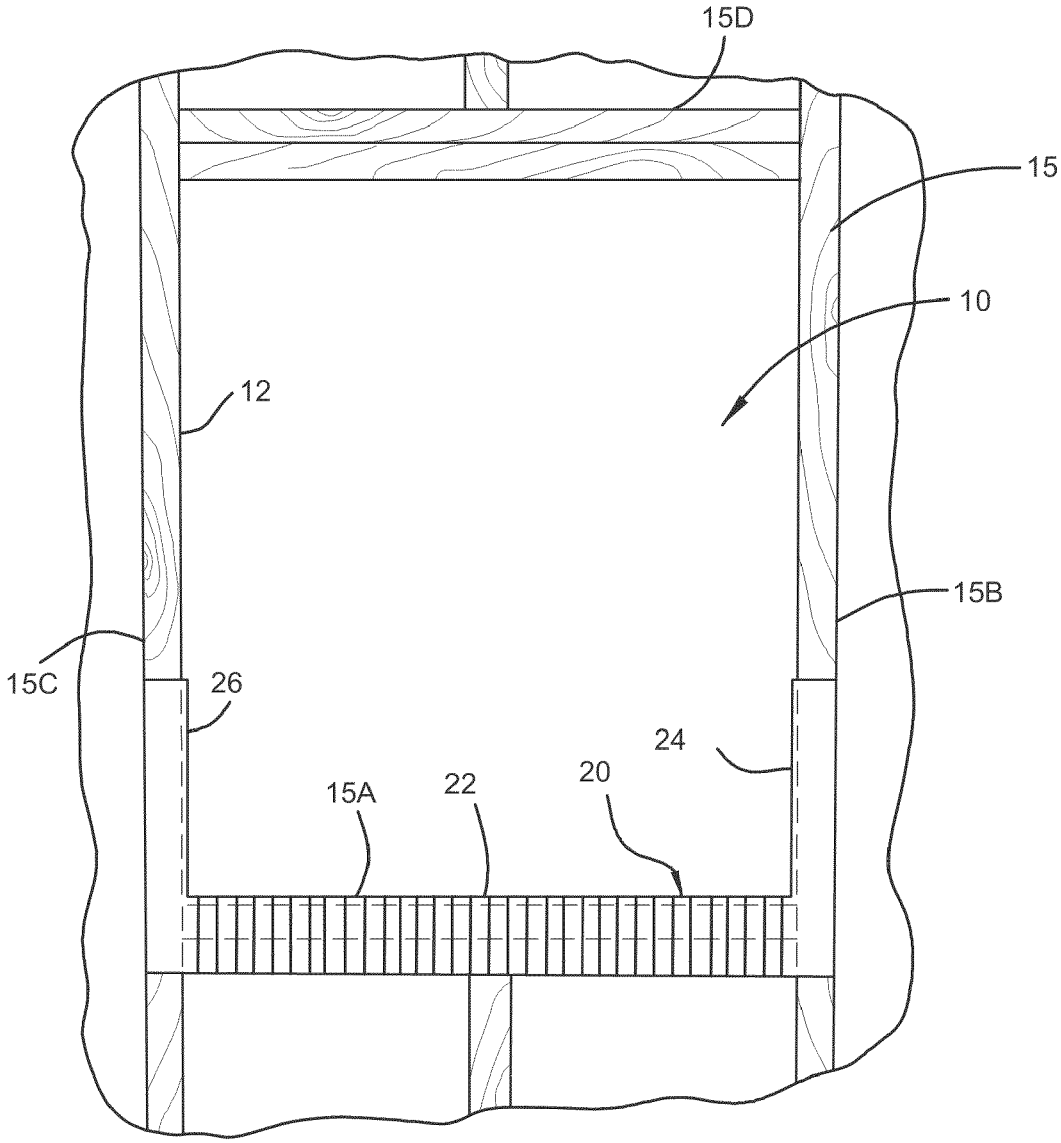
FIG. 1 is a front plan view of a portion of a wall having a rough opening for a window therein, the rough opening having a first embodiment of the moisture management system according the present invention positioned on the framework of the rough opening, the device being illustrated as composed of three pieces.

Referring to the figures, wherein like numerals represent like parts throughout the several views, there is illustrated in FIG. 1 a portion of a conventional 2×4 or 2×6 wall having a rough opening 10 for a fixture or an insert; in the particular illustration of FIG. 1, rough opening 10 is configured for receiving a window. A frame 15 defines rough opening 10, particularly, by a sill plate 15*a*, side members 15*b*, 15*c*, and a header 15*d*. Frame 15 has an interior surface 12 which is defined by all of sill plate 15*a*, side members 15*b*, 15*c*, and header 15*d*. Illustrated positioned on a portion of frame 15 is a fluid management system 20, according to the present invention.

In the configuration illustrated in FIG. 1, fluid management system 20 can be referred to as a flashing for frame 15, and includes a first piece 22, a second piece 24, and a third piece 26, which together extend across and cover sill 15*a* and portions of side members 15*b*, 15*c*. As can be seen in FIG. 1, first piece 22 covers at least a portion of sill 15*a*, second piece 24 covers a portion of sill 15*a* and side member 15*b*, and third piece 26 covers a portion of sill 15*a* and side member 15*c*. System 20 is installed on frame 15 so as to preferably cover the entire bottom horizontal sill 15*a* of frame 15. System 20 additionally and preferably extends up side members 15*b*, 15*c* a portion of their length.

System 20 is configured so that if any window installed in rough opening 10 were to leak, the fluid that might leak down through or along the side of the window fixture would run onto system 20, which is present between the window fixture and frame 15. System 20 provides a path for fluid to be channeled away from inside surface 12 of rough opening 10 and out onto the waterproofed exterior of the wall in which rough opening 10 is framed.

Figure 2:
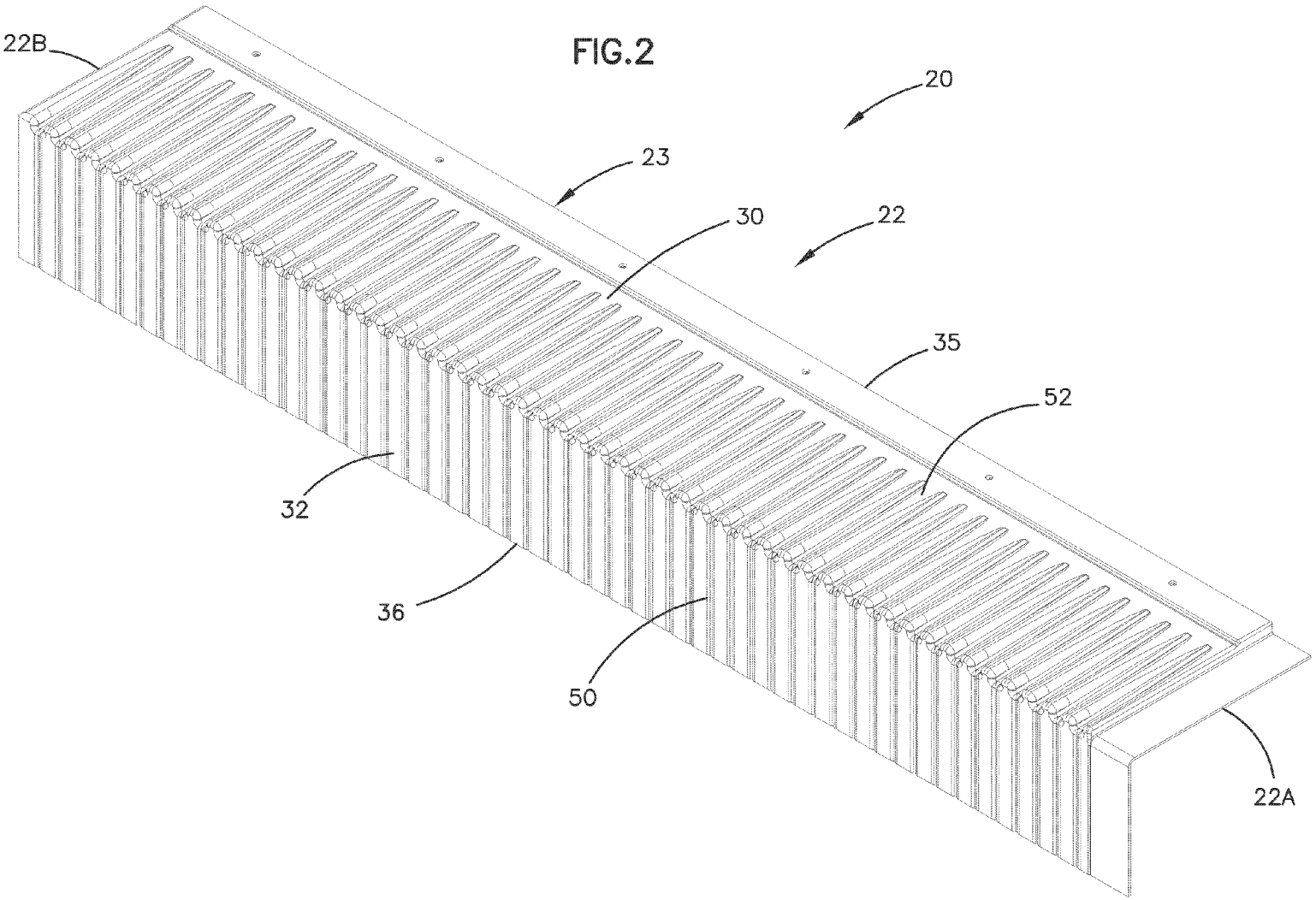
FIG. 2 is a perspective view of a first piece of the system of the present invention, the first piece being one of the three of FIG. 1.
Figure 3:
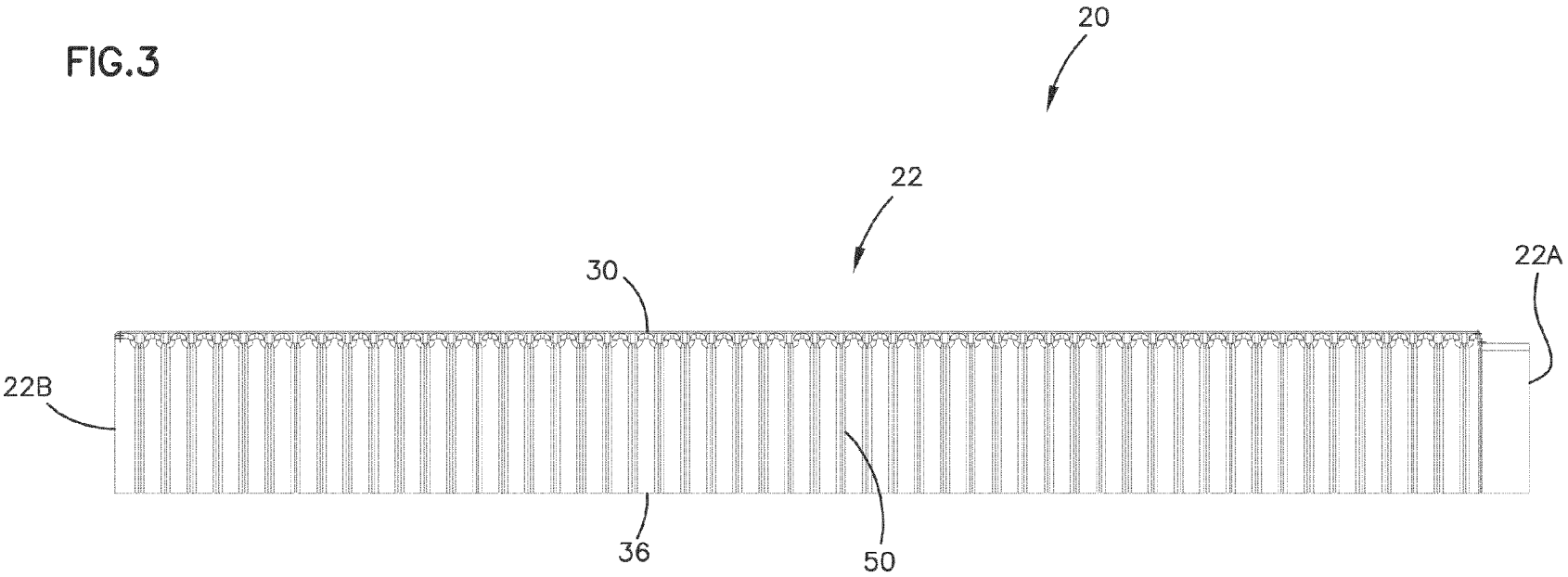
FIG. 3 is a front plan view of the piece of FIG. 2.
Figure 4:
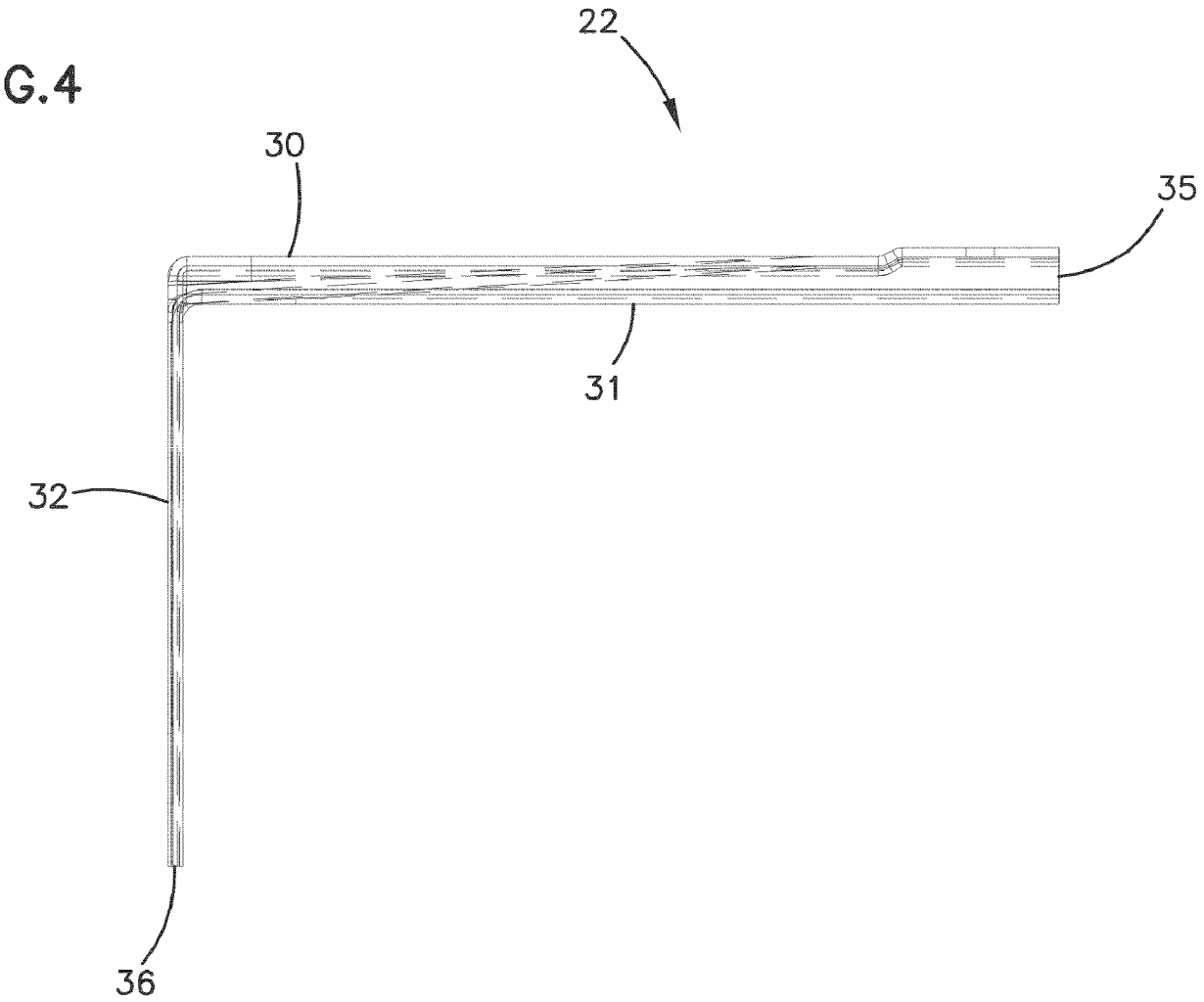
FIG. 4 is a side plan view of the piece of FIGS. 2 and 3.

FIGS. 2 through 4 are illustrations of a first piece 22 that forms system 20. Piece 22 may be used in conjunction with other pieces, such as pieces 24, 26 to form system 20; alternately, piece 22 may be the only piece of system 20.

Piece 22 has an elongate, generally straight body 23 that extends from first end 22*a* to second end 22*b*. Body 23 has a first face 30 and a second face 32 that is positioned approximately orthogonal to face 30; that is, faces 30 and 32 are at approximately a 90-degree angle to each other. When installed on sill 15*a*, face 30 is the surface that sits generally on interior surface 12 of sill 15*a*.

As best seen in FIGS. 2 and 4, piece 22 includes an inner edge 35, which is the edge of body 23, that when installed on frame 15, is the internal-most or interior-most edge of piece 22. That is, inner edge 35 is closest to the interior of the building. Piece 22 also includes a lower edge 36, which is the edge of body 23, that when installed on frame 15, is the portion of piece 22 closest to the ground or foundation of the building. In the embodiment illustrated in FIGS. 2 through 4, lower edge 36 defines the edge of face 32.

As stated above, face 30 is the surface that sits generally on interior surface 12 of sill 15*a*. Face 30 may be horizontal; however, preferably face 30 has a slight slope associated with it, the slope being downward from inner edge 35 toward face 32, the slope thus being away from the interior of the building. Additional details regarding the slope are provided below.

System 20 includes the sloped surface, i.e., face 30, to facilitate movement of fluid, which includes water and air, away from inner edge 35 and away from the interior of the building. System 20 provides a pathway for the fluid to drain from between system 20 and any window installed in rough opening 10.

A preferred system 20 includes at least one pathway, defined by face 30, to facilitate the fluid flow. The number of pathways within system 20 can be any suitable number to provide adequate fluid flow. Typically, there is at least one pathway per foot of system 20, and usually at least one pathway per 2-3 inches. Preferably, there is at least one pathway per inch of system 20.

Figure 8:
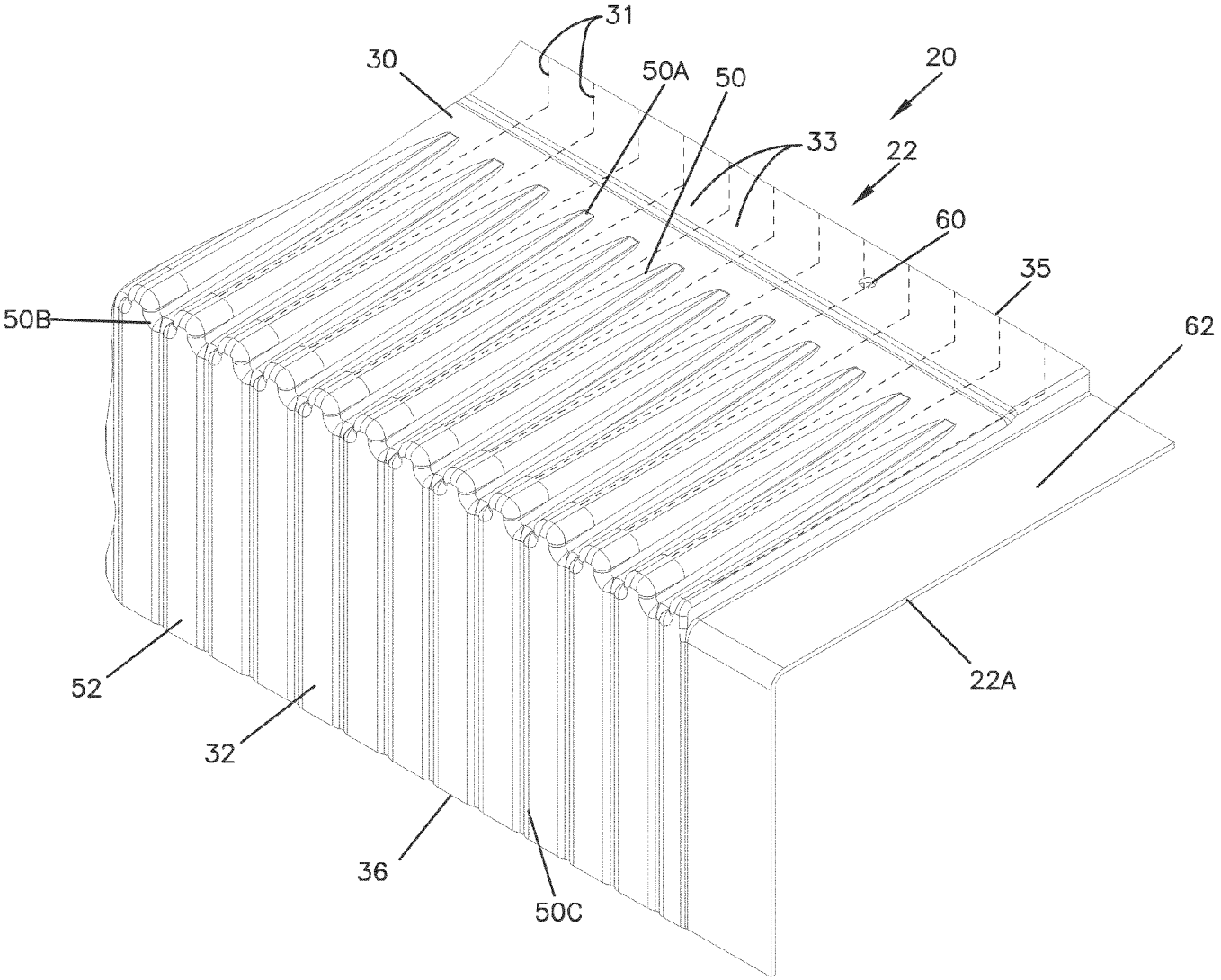
FIG. 8 is an enlarged section of the piece of FIG. 2.

These pathways are illustrated in greater detail in FIG. 8. As seen in FIG. 8, piece 22 includes a multiplicity of pathways 50 present within and defined by face 30 and by face 32. Pathway 50 includes a first end 50*a*, which is the end of pathway 50 closest to edge 35. Pathway 50 also includes a midpoint 50*b*, which is positioned at the intersection of face 30 and face 32. Pathway 50 has a second end 50*c*, located proximate edge 36. Preferably, pathways 50 are parallel to each other. Separating pathways 50 are land portions 52.

Pathways 50, in face 30, are grooves that are sloped away from edge 35 and the interior of rough opening 10 when system 20 is installed properly. In other words, the highest portion of pathway 50 is oriented closest to the interior edge of interior surface 12 of rough opening 10. Pathway 50 has an angle or slope associated with it, this slope extending downward from end 50*a* to midpoint 50*b*. Due to the sloped or angled pathway 50, the depth of pathway 50, from end 50*a* to midpoint 50*b*, is different. The shallowest point of pathway 50 in face 30 is at first end 50*a* and the deepest point of pathway 50 in face 30 is at midpoint 50*b*. The slope of pathway 50 facilitates movement of fluid, particularly of water, due to the effects of gravity, from end 50*a* to midpoint 50*b*.

The sloped angle, measured from the horizontal surface of face 30, is at least 1 degree and is typically no more than about 15 degrees. A preferred slope for pathway 50 from first end 50*a* to midpoint 50*b* is approximately 3.5 degrees, although it is understood that other slopes, shallower or steeper, could be used.

Pathway 50, from midpoint 50*b*, continues on to be defined by face 32. The portion of pathway 50 defined by face 32 is typically of constant depth; that is, there is no slope in the portion of pathway 50 defined by face 32. However, it is understood that a slope or taper could be present. Pathway 50 defined by face 32 extends from midpoint 50*b* to an end 50*c* of pathway 50 proximate edge 36. Pathway 50 facilitates movement of fluid, particularly of water due to the effects of gravity, from midpoint 50*b* to end 50*c*.

Pathways 50 promote efficient fluid transport from the space between rough opening 10 and any fixture that is installed. Pathways 50 defined by face 32 allow fluid transport even when a fixture with is fully installed and a nailing flange on the bottom of the fixture is flushed up to face 32.

Figure 6:
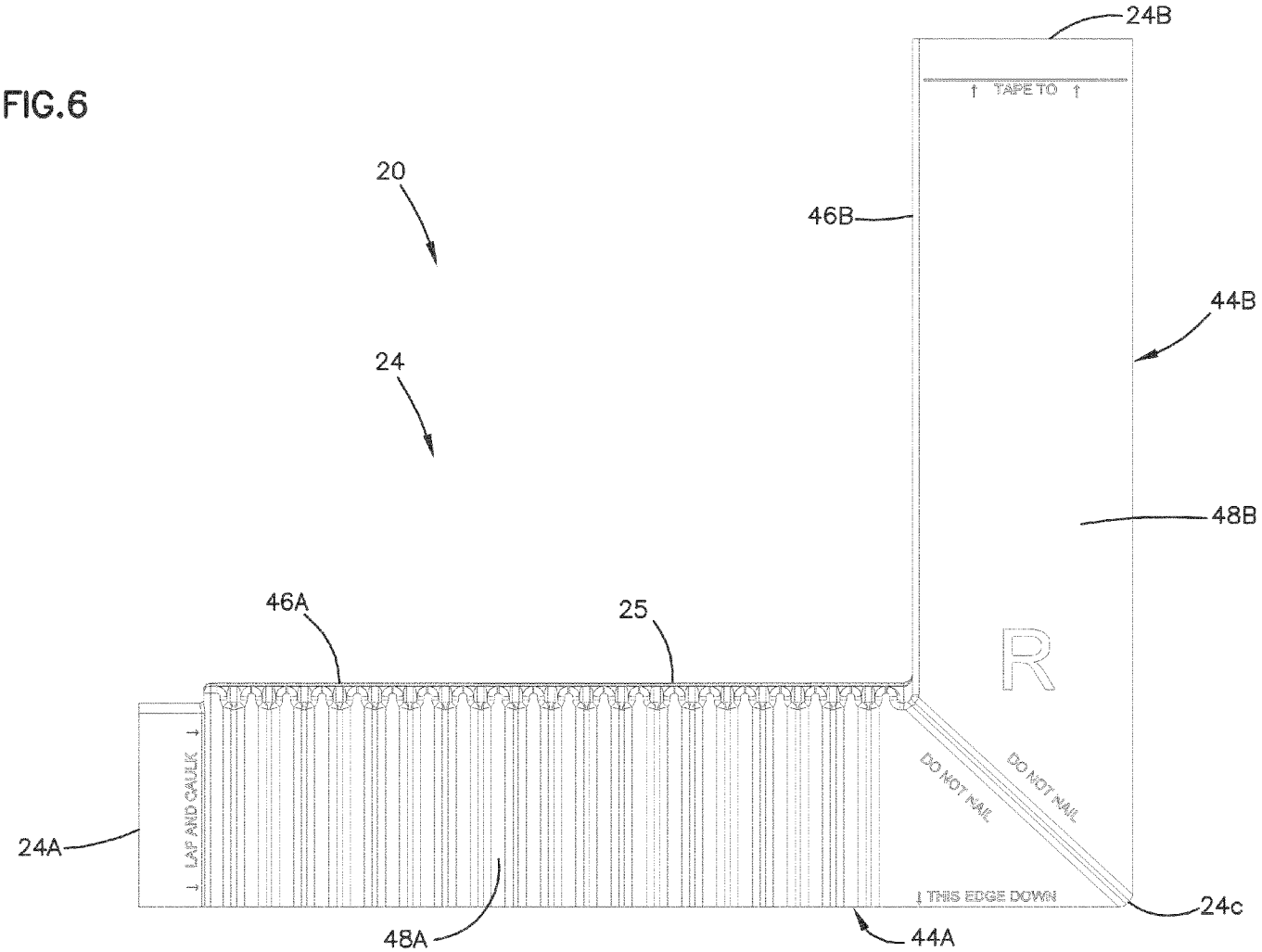
FIG. 6 is a front plan view of the piece of FIG. 5.
Figure 7:
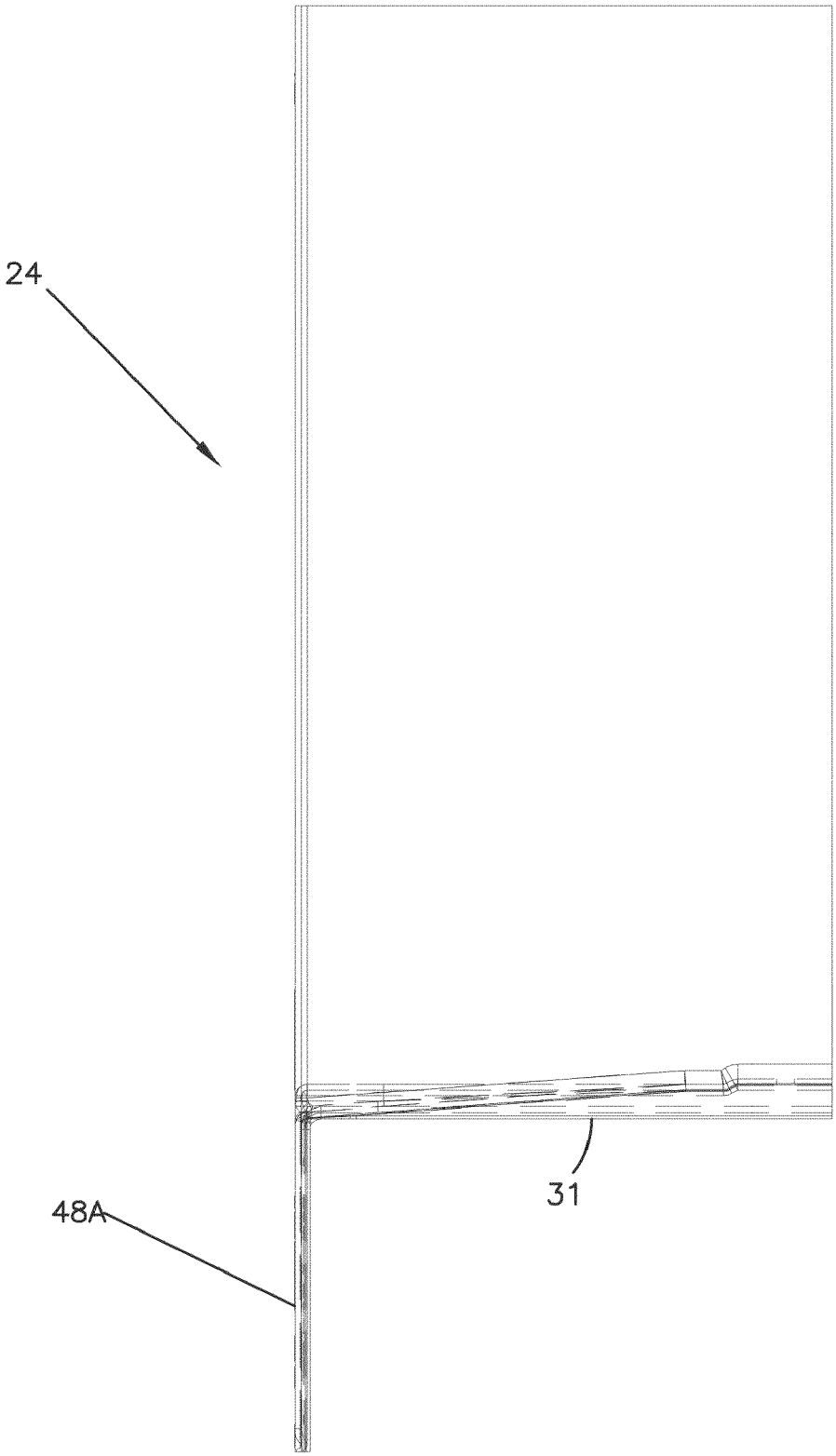
FIG. 7 is a side plan view of the piece of FIGS. 5 and 6.

Referring again to FIG. 1, system 20 illustrated in FIG. 1 includes piece 22 and pieces 24, 26. Together, these three pieces 22, 24, 26 cover sill 15*a* and portions of side members 15*b*, 15*c*. Piece 22 has been described above. Piece 24, which also forms system 20, is now described, referring to FIGS. 5 through 7. Piece 24 has a body 25 that extends from first end 24*a* to second end 24*b*.

Piece 24, and body 25, has a first arm 44*a* and a second arm 44*b*, that is positioned approximately at a 90-degree angle to arm 44*a*. First arm 44*a* has a first face 46*a* and a second face 48*a* that is positioned approximately orthogonal to face 46*a*; that is, faces 46*a* and 48*a* are at approximately a 90-degree angle to each other. When installed on sill 15*a*, face 46*a* is the surface that sits generally on interior surface 12 of sill 15*a*. Similarly, second arm 44*b* has a first face 46*b* and a second face 48*b* that is positioned approximately orthogonal to face 46*b*; that is, faces 46*b* and 48*b* are at approximately a 90-degree angle to each other. When installed on frame 15, face 44*b* is the surface that sits generally on interior surface 12 of side member 15*b*.

Piece 24 includes an inner edge 47, which is the edge of body 25, that when installed on frame 15, is the internal-most or interior most edge of piece 24. That is, inner edge 47 is closest to the interior of the building.

Similar to the construction of piece 22 described above, face 46*a* is the surface that sits generally on interior surface 12 of sill 15*a*. Face 46*a* may be horizontal; however, preferably face 46*a* has a slight slope associated with it, the slope being downward from inner edge 47 toward face 48*a*, the slope thus being away from the interior of the building.

Similar to piece 22, piece 24 includes pathways 50. Pathway 50 includes a first end 50*a*, which is the end of pathway 50 closest to edge 35. Pathway 50 also includes a midpoint 50*b*, which is positioned at the intersection of face 46*a* and face 48*a*. Pathway 50 has an angle or slope associated with it, this slope extending downward from end 50*a* to midpoint 50*b* of pathway 50*a*. Due to the sloped or angled pathway 50, the depth of pathway 50, from end 50*a* to midpoint 50*b*, is different. The shallowest point of pathway 50 in face 30 is at first end 50*a* and the deepest point of pathway 50 in face 30 is at midpoint 50*b*. The slope of pathway 50 facilitates movement of fluid, particularly of water due to the effects of gravity, from end 50*a* to midpoint 50*b*.

Referring again to FIG. 1, system 20 includes piece 26, which is positioned on sill 15*a* and side member 15*c*. Piece 26 is similar to piece 24, yet a mirror image. Piece 26 includes similar features as piece 24, although configured for installation in the opposite corner of frame 15.

As mentioned above, pieces 22, 24, 26, which in any configuration or combination form fluid management system 20, are each preferably a unitary or single piece. Pieces 22, 24, 26 could be metal, such as aluminum or tin, however, pieces 22, 24, 26 are preferably made from polymeric materials such as polyethylene, polypropylene, polyimides, polytetrafluoroethylene, and the like. Polymeric materials are preferred due, at least in part, to the ease of molding pathways 50 therein. The polymeric material could be fiber reinforced. Although examples of metal and polymers have been provided, it is understood that system 20 could be made from any material that inhibits, and preferably eliminates, water penetration, that does not become brittle in cold temperatures or melt in hot temperatures, and that can easily be cut on a job site.

System 20 inhibits moisture from leaking through a fixture installed on system 20 and into the framework of rough opening 10 by catching the fluid and directing it away from the space between the fixture and rough opening 10 via pathways 50. Pathways 50 also provide for airflow underneath the fixture, which would help dry out any fluid or moisture that might accumulate in amounts not great enough to actually flow out of the space through the pathways 50.

One particular, preferred system 20 consists of piece 22, piece 24, and piece 26, having the following features.

Figure 5:
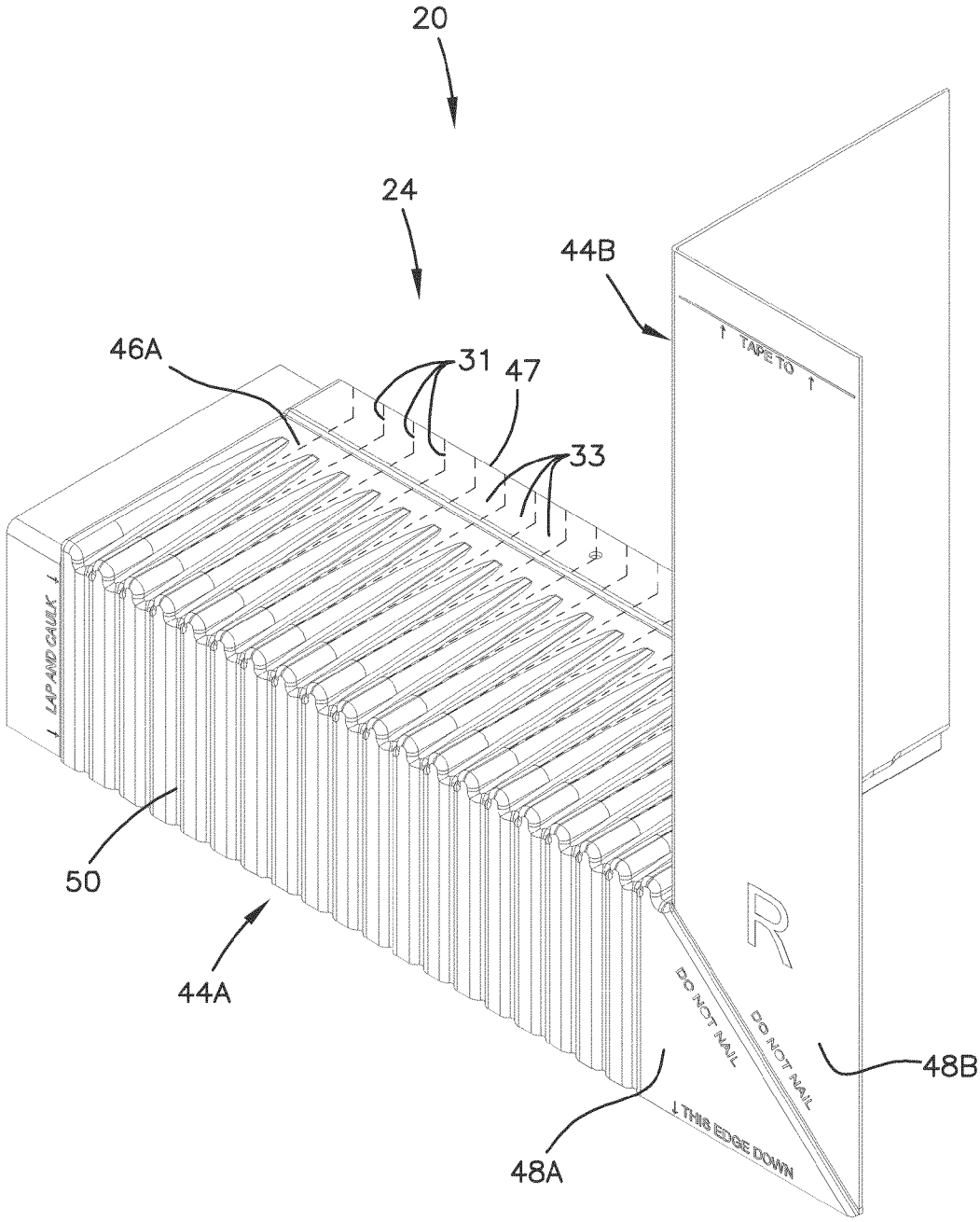
FIG. 5 is a perspective view of a second piece of the system of the present invention, the second piece being one of the three of FIG. 1.

Piece 22 has a length, from end 22*a* to 22*b* of about 36 inches. The depth of face 30, from inner edge 35 to face 30, is about 6 inches. The depth of face 32, from face 30 to lower edge 36, is about 4 inches. Piece 22 has 52 pathways 50 molded therein, each pathway 50 being about 0.25 inches wide. Pathways 50 have land areas 52 therebetween, land 52 being about 0.5 inches wide. The slope of pathways 50 on face 30 is about 3.4-3.5 degrees. The depth of pathway 50 at midpoint 50*b* is about 0.25 inches. The lower surface of face 30 includes reinforcing members 31 extending parallel with pathways 50 to strengthen piece 22. The reinforcing members 31 define cavities 33 therebetween, as shown in FIGS. 5 and 8. The thickness of face 30, from land 52 to the bottom of the reinforcing members 31, is about 0.38 inches.

Arm 44*a* of piece 24 has a length, from end 24*a* to corner 24*c* of about 18 inches. Arm 44*b* of piece 24 has a length, from corner 24*c* to end 24*b* of about 16 inches. The depth of face 46*a*, from inner edge 47 to face 48*a*, is about 6 inches. Arm 44*a* has 19 pathways 50 molded therein, each pathway being about 0.25 inch wide. The slope of pathways 50 on face 46*a* is about 3.5 degrees. The lower surface of face 46*a* includes reinforcing members 31 extending parallel with pathways 50 to strengthen arm 44*a*. Arm 44*b* does not include pathways 50.

Piece 26 is the mirror image of piece 24.

The airflow possible between the fixture and system 20 is particularly beneficial for vinyl or aluminum siding, which are hung relatively loosely on the outside of the exterior wall of a building. System 20 is also useful for stucco, cement, and other such sidings. The design, as well as the method of installing the siding, results in airspace between the siding and a usually present moisture barrier, such as Tyvek™ wrap, on the exterior of the wall construction. Pathways 50 of system 20 lead into the airspace between the siding and exterior wall construction, namely, the moisture barrier. Pathways 50, in effect, tap into the airspace between any siding and the construction of an exterior wall allowing air to flow underneath any fixture installed in rough opening 10 with system 20, allowing moisture to dry.

Figure 9:
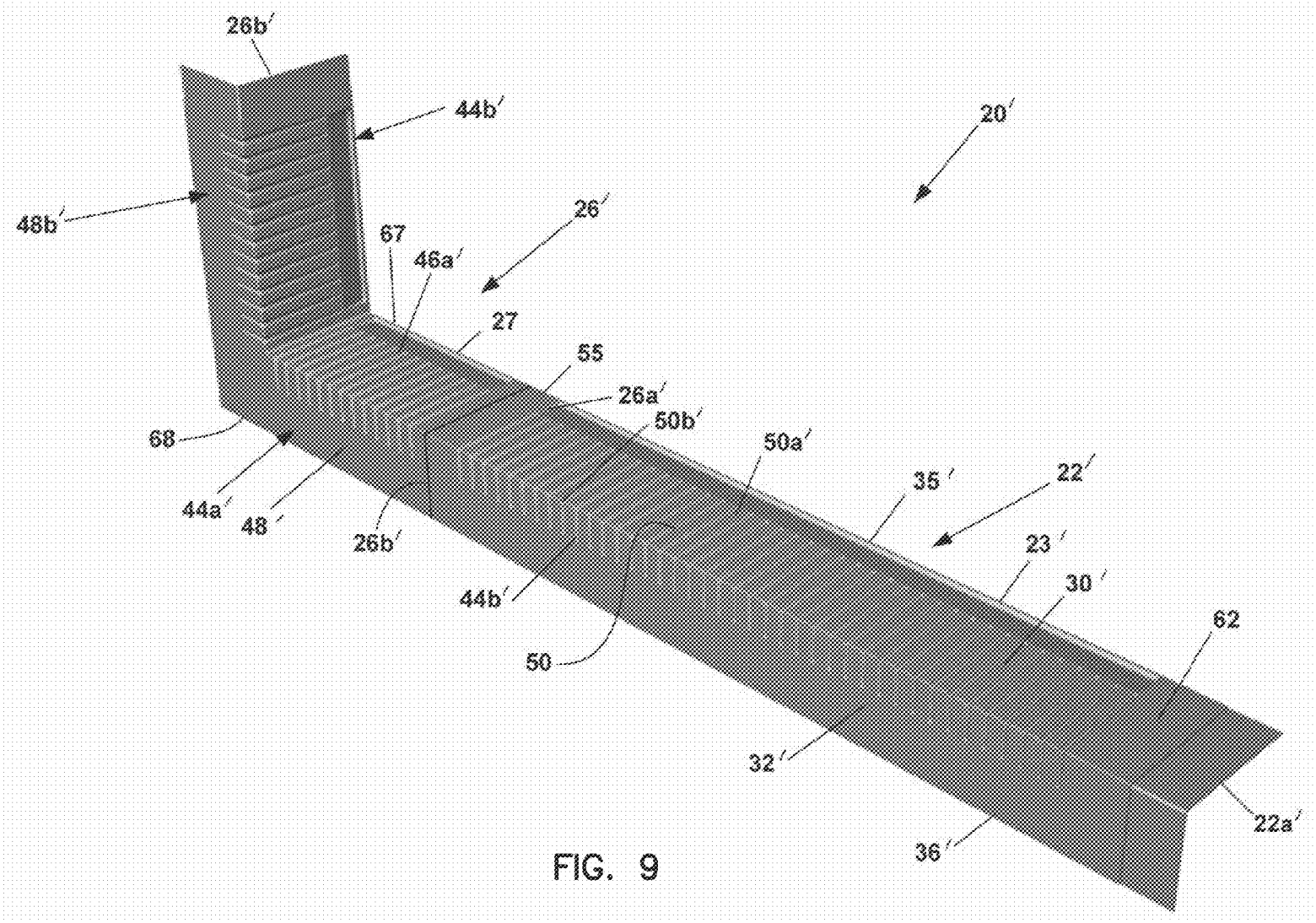
FIG. 9 is a perspective view of two pieces of a second embodiment of the moisture management system of the present invention.

A second embodiment of a system according to the present invention is shown in FIG. 9. In this embodiment, a system 20' is illustrated, similar to system 20 of FIGS. 1 through 8. The particular pieces of system 20' in FIG. 9 are comparable to pieces 22 and 26 of FIG. 1. That is, system 20' of FIG. 9 shows two pieces, piece 22' and 26'.

Piece 22' similar to piece 22, described above. Piece 22' has an elongate, generally straight body 23' that extends from first end 22*a*' to second end 22*b*'. Body 23' has a first face 30' and a second face 32' that is positioned approximately orthogonal to face 30'. When installed on sill 15*a* (FIG. 1), face 30' is the surface that sits generally on interior surface 12 of sill 15*a*. Piece 22' includes an inner edge 35' and a lower edge 36'. Pathways 50' extend across face 30', from a first end 50*a*' to a midpoint 50*b*'. Pathways 50' continue down face 32', to an end 50*c*'. Unlike the first embodiment (i.e., system 20), end 50*c*' is removed from edge 36'. Piece 22' includes a land area 62, proximate end 22*a*', which is free of pathways 50'.

Piece 22' is joined to piece 26' at a joint 55. Piece 26' has a body 27 that extends from first end 26*a*' to second end 26*b*'. Piece 26', and body 27, has a first arm 44*a*' and a second arm 44*b*', that is positioned approximately at a 90-degree angle to arm 44*a*'. First arm 44*a*' has a first face 46*a*' and a second face 48*a*' that is positioned approximately orthogonal to face 46*a*'; that is, faces 46*a*' and 48*a*' are at approximately a 90-degree angle to each other. When installed on sill 15*a*, face 46*a*' is the portion that sits generally on interior surface 12 of sill 15*a* (FIG. 1) and face 48*a*' is the portion that sits generally on the exterior wall of the building. Similarly, second arm 44*b*' has a first face 46*b*' and a second face 48*b*' that is positioned approximately orthogonal to face 46*b*'; that is, faces 46*b*' and 48*b*' are at approximately a 90-degree angle to each other. When installed on frame 15, face 46*b*' is the surface that sits generally vertical on interior surface 12 of side member 15*b* and face 48*b*' is the portion that sits generally on the exterior wall of the building.

Piece 26' includes an inner edge 67 and a lower edge 68, which are the edges of body 27, that when installed on frame 15, is the internal-most or interior most edge of piece 26'. That is, inner edge 67 is closest to the interior of the building. Similar to piece 22', piece 26' includes pathways 50', which are located both on arm 92*a* and arm 92*b*.

Piece 22', and piece 26' are joined at joint 55, which is formed by overlapping end 22*b*' of piece 22' with end 26*a*' of piece 26'. Preferably, at least one of piece 22' and piece 26' includes land portion 62 at an end thereof to facilitate joining.

In use, system 20 is installed in rough opening 10 of an exterior wall. System 20 is designed to be installed between the construction of rough opening 10 and any fixture, like a window or door, which is placed in the rough opening. To install, a builder would first frame up and insulate an exterior wall. Then, the framework and insulation of the wall would be covered in a waterproof exterior building wrap or moisture barrier 11 (See FIG. 1). The moisture barrier 11 would extend to the rough opening, and optionally be folded over frame 15 that forms rough opening 10. System 20 would be installed in rough opening 10 so that face 32 (of piece 22), faces 46*a* and 46*b* (of piece 24), face 32' (of piece 22') and faces 46*a*' and 46*b*' (of piece 26') lay over the exterior of the wrap 11. This way any moisture is directed away from the interior of rough opening 10, by system 20, and would be channeled down over the wrap 11. Any moisture would run down the outside of the wrap or moisture barrier 11 and into the space between the wrap or moisture barrier 11 and the siding, without coming into contact with the framework construction of the wall. System 20 can be held into place by a frictional fit with any fixture that is subsequently installed on top of system 20. Adhesive could also be used. Alternatively, yet preferably, system 20 is be held into place with an anchoring device, such as nails, staples or screws. System 20 can include anchor apertures 60, such as on face 30 (of piece 22) or face 44*a* of (piece 24) to provide an area for anchoring devices to pass through the pieces. Any combination of anchoring devices or frictional forces from the subsequently installed fixture could be used to secure system 20.

The fixture that is installed in rough opening 10 on system 20 would be leveled with shims, as is conventionally done. The fixture would likely be shimmed from the inside of the building. The shims would be inserted between system 20 and the fixture installed on system 20.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size and arrangement of parts and types of materials within the principles of the disclosure to the full extent indicated by the broad general meaning of the terms in which the appended claims are expressed.

What is claimed is:

1. A flashing assembly comprising:

a corner flashing member extending from a corner member elbow toward a corner member end portion, the corner flashing member includes:

a corner member mounting face configured for coupling within a building rough opening, wherein the corner member mounting face includes a first plurality of channels recessed from a corner member planar mounting surface, and a corner member wall face configured for coupling over a wall, and the corner member wall face is at an angle relative to the corner member mounting face;

a straight flashing member extending from a first member end portion to a second member end portion, the straight flashing member is coupled at a flashing joint including the first member end portion and the corner member end portion, the straight flashing member includes:

a straight member mounting face configured for coupling within a building rough opening, wherein the straight member mounting face includes a second plurality of channels recessed from a straight member planar mounting surface, and a straight member wall face configured for coupling over a wall, and the straight member wall face is at an angle relative to the straight member mounting face; and one or both of the corner flashing member and the straight flashing member include an end land portion, the end land portion is lapped over one of the corner member end portion or the first member end portion, and the end land portion isolates the flashing joint, wherein the end land portion separates the first and second plurality of channels from the flashing joint.

2. The flashing assembly of claim 1, wherein one or more of the first or second plurality of channels are sloped relative to the respective corner member or straight member planar mounting surfaces.

3. The flashing assembly of claim 1, wherein one or more of the corner member or straight member wall faces include a third plurality of channels extending from one or more of the respective corner member or straight member mounting faces toward a lower edge, and the third plurality of channels are in communication with one or more of the first and second plurality of channels on the corner member or straight member mounting faces.

4. The flashing assembly of claim 3, wherein the third plurality of channels extending toward the lower edge is conterminous with the lower edge.

5. The flashing assembly of claim 1, wherein one or more of the corner member or straight member planar mounting surfaces includes one or more planar land portions between the channels of the first or second plurality of channels, and the planar land portions are level with a lower surface portion of one or more of the corner member or straight member wall faces configured for coupling within a building rough opening.

6. The flashing assembly of claim 1, wherein one or more of the corner member or straight member planar mounting surfaces includes a raised interior profile, the raised interior profile extends along an inner edge of one or more of the respective corner flashing or straight flashing members, and a remainder of the respective corner member or straight member planar mounting surface is recessed relative to the raised interior profile.

7. The flashing assembly of the claim 1, wherein one or more of the corner member or straight member planar mounting surfaces respectively extends continuously from a corner member elbow to a corner member end portion or a first member end portion to a second member end portion.

8. The flashing assembly of claim 1, wherein the corner member mounting face includes a first portion at an angle to a second portion.

9. The flashing assembly of claim 8, wherein the first portion and the second portion include the first plurality of channels.

10. A flashing system comprising:

a flashing member extending from a first end portion to a second end portion, the flashing member includes:

a mounting face configured for coupling within a building rough opening, wherein the mounting face includes a first plurality of channels recessed from a flashing member mounting surface, and the first plurality of channels are separated from one or both of the first or second end portions, a wall face configured for coupling over a wall, and the member wall face is at an angle relative to the mounting face, the wall face includes a second plurality of channels recessed from a wall face exterior, the second plurality of channels are in communication with the first plurality of channels, and the second plurality of channels are separated from one or both of the first or second end portions, wherein the first plurality of channels are sloped relative to the flashing member mounting surface, and the first plurality of channels slope toward the wall face, and at least one end land portion configured for lapping over an end portion of another flashing member, the at least one end land portion separates the first and second plurality of channels from one or both of the first or second end portions.

11. The flashing system of claim 10, wherein the flashing member is a corner flashing member, and the mounting face includes a first portion at an angle to a second portion, and the first portion and the second portion include the first plurality of channels.

12. The flashing system of claim 10, wherein the second plurality of channels extend from the mounting face toward a lower edge of the wall face.

13. The flashing system of claim 10, wherein the flashing member includes one or more planar land portions between the channels of the first plurality of channels, and the planar land portions are level with a lower surface portion of the mounting face.

14. The flashing system of claim 10, wherein the flashing member mounting surface includes a raised interior profile, the raised interior profile extends along an inner edge of the mounting face, and a remainder of the flashing member mounting surface is recessed relative to the raised interior profile.

15. The flashing system of the claim 10, wherein the flashing member mounting surface extends continuously from the first end portion to a second end portion.

16. A method for installing a flashing assembly comprising:

installing a corner flashing member within a building rough opening including:

positioning a corner member mounting face within the building rough opening, the corner member mounting face including a first plurality of channels recessed from a corner member planar mounting surface, and positioning a corner member wall face of the corner flashing member over a wall, the corner member wall face is at an angle relative to the corner member mounting face; installing a straight flashing member within a building rough opening including:

positioning a straight member mounting face of a straight flashing member within the building rough opening, the straight member mounting face including a second plurality of channels recessed from a straight member planar mounting surface;

positioning a straight member wall face of the straight flashing member over the wall, the straight member wall face is at an angle relative to the corner member mounting face; and lapping an end land portion of one of the corner flashing member and the straight flashing member over one of a corner member end portion or a straight member end portion, and the end land portion isolates a flashing joint between the corner and straight flashing members, wherein lapping the end land portion separates the first and second plurality of channels from the flashing joint.

17. The method of claim 16, wherein positioning of the corner member mounting face and the straight member mounting face includes forming a planar mounting surface across the corner member and the straight member with the corner member planar mounting surface and the straight member planar mounting surface.

18. The method of claim 16, wherein positioning of one or more of the corner member or straight member wall faces includes positioning one or more of the corner member or straight member wall faces over a building wrap on the wall.

19. The method of claim 18 comprising positioning siding over one or more of the corner member or straight member wall faces and the building wrap, and the wall faces are interposed between the siding and the building wrap.

20. The method of claim 16, wherein positioning of one or more of the corner member or straight member wall faces includes positioning a third plurality of channels on one or more of the corner member or straight member wall faces between a building wrap and siding.

* * * * *

UNITED STATES PATENT AND TRADEMARK OFFICE

CERTIFICATE OF CORRECTION

PATENT NO. : 8,065,839 B2
APPLICATION NO. : 12/558179
DATED : November 29, 2011
INVENTOR(S) : Conlin It is certified that error appears in the above-identified patent and that said Letters Patent is hereby corrected as shown below:

On the face page, in field (75), in "Inventor", in column 1, line 1, after "Kelly" insert -- Joseph --.

On the face page, in field (73), in "Assignee", in column 1, line 1, after "Company," insert -- d/b/a Marvin Windows and Doors, --.

In column 8, line 24, in Claim 7, after "of" delete "the".

In column 9, line 13, In Claim 15, after "of" delete "the".

Signed and Sealed this
Twenty-eighth Day of February, 2012

David J. Kappos

David J. Kappos
*Director of the United States Patent and Trademark Office*